United States Patent [19]

Davies et al.

[11] Patent Number: 4,882,553

[45] Date of Patent: Nov. 21, 1989

[54] MICROWAVE BALUN

[75] Inventors: Robert Davies, Copthorne, England; Percy W. Hoare, Hussocks, United Kingdom; Peter J. Gibson, Crawley, England

[73] Assignee: U.S. Philips Corp., New York, N.Y.

[21] Appl. No.: 247,139

[22] Filed: Sep. 21, 1988

[30] Foreign Application Priority Data

Sep. 25, 1987 [GB] United Kingdom ..... 8722638

[51] Int. Cl.[4] ..... H01P 5/10

[52] U.S. Cl. ..... 333/26; 333/246

[58] Field of Search ..... 333/26; 343/859; 455/327

[56] References Cited

U.S. PATENT DOCUMENTS 4,135,170 1/1979 Baril et al. ..... 333/26
4,460,877 7/1984 Sterns ..... 333/26
4,485,488 11/1984 Houdart ..... 333/26 X

FOREIGN PATENT DOCUMENTS 2057196 3/1981 United Kingdom ..... 333/26

*Primary Examiner*—Paul Gensler
*Attorney, Agent, or Firm*—Emmanuel J. Lobato

[57] ABSTRACT

A broadband balun, suitable for feeding a spiral antenna, has a balanced port (20) comprising two adjacent strip conductors (16,17; 36,37) which are coupled to the unbalanced port (6) by respective paths of the same effective electrical lengths. The paths comprise respective strip transmission lines (9,10) having a common ground conductor (3; 44) which terminates in a transition to the balanced line (19), and further comprise slot line means (11; 21) and strip transmission line-to-slot line coupling means (14,15) so arranged as in operation to provide in the two strip conductors (16,17; 36,37) from an RF signal at the unbalanced port (6) signals of mutually opposite phases with respect to the common ground conductor (3; 44).

The two strip conductors (16,17) may be disposed on the outer surfaces of two substrates (1,2) with a ground plane (3) between the substrates, or may be coplanar (36,37) with a transition to an unbalanced line comprising strip conductors (45, 46) on opposite sides of a central ground conductor (44) in the same plane.

19 Claims, 3 Drawing Sheets

MICROWAVE BALUN

BACKGROUND OF THE INVENTION

The invention relates to a balun suitable for use at microwave frequencies. (The term "microwave" is to be understood to include millimeter waves). A balun embodying the invention may particularly but not exclusively be suitable for use over a broad range of frequencies, such as 5:1 or more, and may particularly but not exclusively be suitable for feeding a spiral antenna.

Microwave systems formed with transmission lines usually employ unbalanced transmission lines such as microstrip, but certain components such as spiral antenna require to be fed in a balanced manner, which may be done from an unbalanced line via a balun. It may be important to ensure that no unbalanced mode of propagation exists at the balanced port of the balun; for example, the presence of such a mode in the feed to a spiral antenna results in the radiation pattern of the antenna squinting with respect to the axis of the spiral. Particularly where the balun is to be operable over a very broad frequency range (a spiral antenna may have a bandwidth as great as 10:1 or more), the balun should then provide a balanced feed in a manner which is frequency-independent in nature over its operating frequency range. It may also be desirable to provide a balun which may be compact and which may be of planar form so as, for example, to be readily compatible with a planar transmission line system.

SUMMARY OF THE INVENTION

According to the invention, a balun has an unbalanced port comprising a first unbalanced transmission line and a balanced port comprising a balanced transmission the line formed by two adjacent elongate strip conductors of substantially the same widths between which in operation the electric field extends. The two strip conductors are coupled to the unbalanced port by respective paths of substantially the same effective electrical lengths, and the paths comprise adjacent respective further unbalanced transmission lines which are strip transmission lines having a common ground conductor. There is a transition from the adjacent unbalanced lines to said balanced line, in which transition the common ground conductor terminates. The paths comprise slot line means and strip transmission line-to-slot line coupling means so arranged as in operation to provide in the two strip conductors from an RF signal in the first unbalanced line RF signals of mutually opposite phases with respect to the common ground conductor.

The invention involves the recognition that the conversion of an unbalanced feed to a balanced feed in a manner which may be essentially independent of frequency over a broad range and which may be free of unbalanced modes in the balanced line may be achieved by providing two adjacent unbalanced lines with a common ground conductor, on the one hand feeding the two unbalanced lines with antiphase signals derived from the unbalanced port in a frequency-independent manner, and on the other hand terminating the common ground conductor of the adjacent antiphase unbalanced lines to derive from the two unbalanced lines a single balanced line. The antiphase signals can be derived in a substantially frequency-independent manner using coupled slot and strip transmission lines.

The two strip conductors may be coupled to the unbalanced port by a shunt-T junction formed in said first unbalanced line. A single one of the paths may then comprise a slot line, said first unbalanced line and a first of the strip conductors being coupled thereto in opposite electrical senses.

The use of a slot line to which two microstrip lines are coupled in opposite electrical senses in order to provide a frequency-independent phase reversal is known from GB No. 1 321 978. However, in that instance, the phase reversal is used in a hybrid ring; a three-quarter wavelength section of the ring between two adjacent ports is replaced by a one-quarter wavelength section into which the phase reversal is in addition introduced to give the same nominal phase shift of 270 degrees. This results in a ring structure of higher symmetry; nevertheless, the performance is still inherently frequency-dependent. There is nothing to suggest supplying antiphase signals to two adjacent unbalanced lines with a common ground conductor and then providing a transition to a balanced line, the ground conductor terminating. Furthermore, while there is an identifiable phase reversal in the section of the known hybrid ring, embodiments of the invention more broadly require an arrangement which produces from a signal at the unbalanced port signals of mutually opposite phases in the two strip conductors; this need not include an identifiable phase reversal in one of the two paths.

For a compact balun of planar form wherein the first unbalanced line is a microstrip line comprising a strip conductor pattern and a ground plane, the slot line means suitably are formed in said ground plane. The second of the two elongate strip conductors may then be substantially coplanar and integral with the strip conductor pattern of said microstrip line.

As an alternative, said slot line means and coupling means may comprise in each path a slot line to which said first unbalanced line and a respective one of the further unbalanced lines are coupled, the further unbalanced lines being coupled to their respective slot line in opposite electrical senses with reference to said first unbalanced line. This has the advantage over the use of a slot line in a single one of the paths that slot line and unbalanced line have different dispersions, an d the characteristics of the two paths may therefore be better matched over a broad frequency range.

As an alternative to a shunt-T junction, a series-T junction may be used to couple the two slot lines to said first unbalanced line.

As a further alternative, said first unbalanced line may be a coplanar line comprising a central strip conductor separated by respective gaps from two portions of a ground plane respectively on opposite sides of the central conductor, wherein said slot line means and coupling means comprise two slot lines respectively contiguous with said gaps, said two elongate strip conductors being respectively coupled to the two slot lines in the same electrical senses.

Where the slot line means are formed in the ground plane of a microstrip line comprising the input port, said common ground conductor suitably comprises said ground plane.

In one form of balanced line comprising the balanced port, the two elongate strip conductors are substantially in spaced respective parallel planes, and are substantially superimposed as viewed in a direction normal to said planes. For a compact arrangement, the or each slot line may then be formed in a ground plane between the respective planes of the two elongate strip conductors, the ground plane terminating between the superimposed strip conductors. Such a balun may be formed on two dielectric substrates disposed respectively on opposite sides of said ground plane and each having a major surface contiguous therewith, wherein on a major surface, remote from said ground plane, of a first of the two substrates are the second strip conductor and the strip conductor pattern of said microstrip line, and wherein on a major surface remote from said conductive layer, of the second substrate is the first strip conductor.

In another form of the balanced line, the two elongate strip conductors may be substantially coplanar. The transition suitably then comprises a third strip conductor which is connected at one end thereof to said ground plane at an edge thereof, which extends away from said ground plane, and which is disposed between fourth and fifth strip conductors, contiguous with the two elongate strip conductors, to form therewith a further unbalanced transmission line, and wherein said ground plane and the fourth and fifth strip conductor form said adjacent further unbalanced transmission lines.

BRIEF DESCRIPTION OF THE DRAWINGS

Embodiments of the invention will now be described, by way of example, with reference to the diagrammatic drawings, in which.

DETAILED DESCRIPTION OF THE INVENTION

Figure 1:
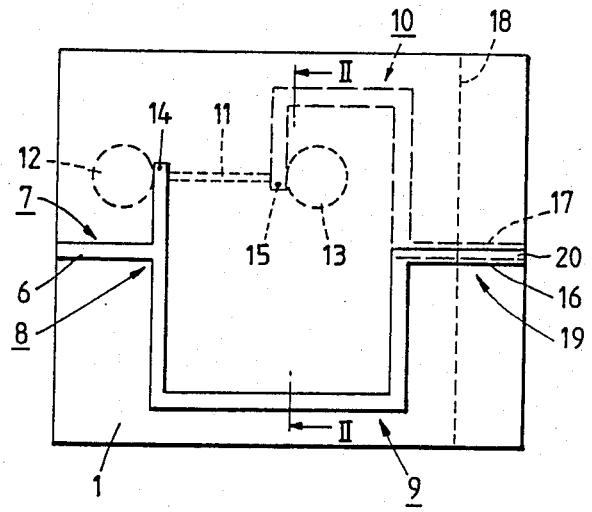
FIG. 1 is a plan view of a first embodiment.
Figure 2:
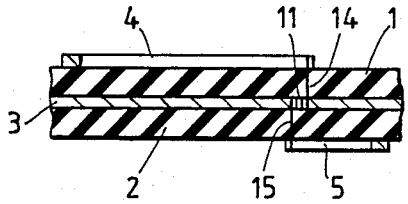
FIG. 2 is a cross-sectional view (not to scale) of the first embodiment of the line II—II in FIG. 1.

A first embodiment of the invention is shown in FIGS. 1 and 2, which are respectively a plan view from above and a cross-section on the line II—II in FIG. 1. This embodiment comprises two dielectric substates 1 and 2 respectively disposed on opposite sides of a conductive layer 3 and each having a major surface contiguous therewith; the topmost and bottommost major surfaces of the pair of substrates carry conductive layers 4 and 5 respectively in the form of strip conductor patterns. In FIG. 1, edges of the topmost layer 4 are indicated by continuous lines, edges of the central layer 3 by lines of short dashes, and edges of the bottomost layer 5 by lines of long dashes.

The balun comprises slot and microstrip lines for which the central conductive layer 3 is a common ground conductor. The unbalanced port 6 of the balun comprises a first microstrip line which is formed on the upper substrate 1 by the conductive layers 4 and 3 and the strip conductor pattern which is indicated generally at 7. A shunt-T junction 8 is formed in this microstrip line to divide a signal from the unbalanced port equally along two paths. A first of these paths comprises a second microstrip line which is integral with the first and the strip conductor pattern which is indicated generally at 9 in FIG. 1. The second path comprises a third microstrip line which is formed on the lower substrate 2 by the conductive layers 5 and 3 and the strip conductor pattern which is indicated generally at 10, and further comprises a slot line 11 formed in the ground plane layer 3. The slot line is terminated at each end by a respective open circuit 12, 13. The first and third microstrip lines are coupled in a broadband manner to the slot line 11 respectively adjacent the open circuits 12 and 13 by virtue of their strip conductors 7, 10 crossing the slot line (as viewed normal to the substrates) and the ends of the strip conductors being connected adjacent the slot line to the central ground plane layer by conductive connections 14, 15 respectively extending through the upper and lower substrates 1, 2. Since the connections 14, 15 are on opposite sides of the slot line 11, the first and third microstrip lines are coupled thereto in opposite electrical senses, with the result that a signal at the unbalanced port produces antiphase signals at points in the second and third microstrip lines that are at equal electrical distances from the T-junction 8.

Figure 3:
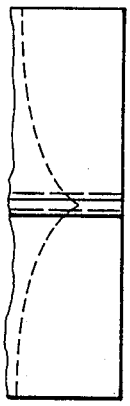
FIG. 3 illustrates an alternative form of ground plane termination.

The strip conductors 9, 10 of the second and third microstrip lines approach each other and are respectively contiguous with two adjacent elongate strip conductors 16 and 17 respectively on the topmost and bottommost major surfaces of the assembly. The conductors 16 and 17 are superimposed as viewed in a direction normal to the substrates, although in FIG. 1 they have for clarity been drawn as been slightly mutually displaced. The ground plane layer 3 extends between the conductors 16, 17 along part of their lengths and terminates at an edge 18 which may be rectilinear as depicted in FIG. 1 or may be gradually tapered to a point between the conductors 16, 17 as depicted in FIG. 3. The portions of the conductors 16, 17 between which the layer 3 extends form therewith two adjacent unbalanced strip (microstrip) transmission lines. The effective electrical lengths of the first and second paths between the shunt-T junction 8 and the superimposed conductors 16, 17 via the second microstrip line and via the slot line 11 and third microstrip line respectively are substantially the same. In view of the phase reversal in the second path, the signal produced in the conductors 16, 17 by a signal applied to the unbalanced port 6 are of mutually opposite phases with respect to the common ground plane 3. The electromagnetic field configurations are mirror images with respect to the plane of the central layer 3, and the currents in the ground plane can be considered to cancel each other. The termination of the layer 3 at edge 18 therefore has substantially no effect and constitutes a substantially reflection-free transition to a balanced line 19 formed by the portions of the conductors 16, 17 between which the layer 3 does not extend (i.e. to the right of edge 18 in FIGS. 1 and 3). In operation, the electric field extends between the conductors 16, 17 in the balanced line 19. The free end of the line 19 constitutes the balanced port 20 of the balun.

Baluns embodying the invention may be considered to comprise two portions. A first portion extends from the unbalanced port to the pair of unbalanced lines, and enables a signal at the unbalanced port to produce signals mutually opposite phases in the pair of unbalanced lines (and, hence, with respect to the common ground conductor, in the two adjacent strip conductors forming the balanced line). The second portion of the balun extends from the pair of unbalanced lines to the balanced port, and combines the pair of unbalanced lines into a signal balanced line by terminating the common ground conductor. FIGS. 4–7 show a modifications of the first portion, and FIG. 8 shows a modification of the second portion.

Figure 4:
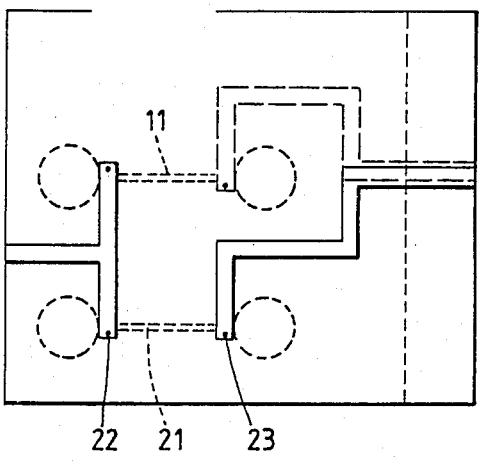
FIGS. 4, 5, 6 and 7 are plan views of second, the third, fourth and fifth embodiments respectively with alternative forms of paths between the unbalanced port and the pair of unbalanced lines.

FIG. 4 shows a second embodiment of the invention which is similar to the first embodiment except that the first as well as the second of the paths comprises a slot line, denoted 21. The first and second microstrip lines are coupled to the slot line 21 in a manner analogous to that in which the first and third microstrip lines are coupled to the slot line 11, except that the respective conductive connections 22, 23 are on the same side rather than opposite sides of the slot and both extend through the upper substrate 1. The electrical lengths of the slot lines between the points at which the respective two microstrip lines are coupled thereto are chosen to be the same so that, bearing in mind that slot line and microstrip line have different dispersions, the electrical characteristics of the two paths and in particular their effective electrical lengths can be more closely matched over a broad bandwidth than in the first embodiment.

The operating frequency ranges of the first and second embodiments, especially the second in which the two paths can be more closely matched, are determined essentially by the frequency ranges over which the couplings of the microstrip lines to the slot lines and the open-circuit terminations of the slot lines are effective. The embodiments are essentially frequency-independent in nature within their operating frequency ranges.

Figure 5:
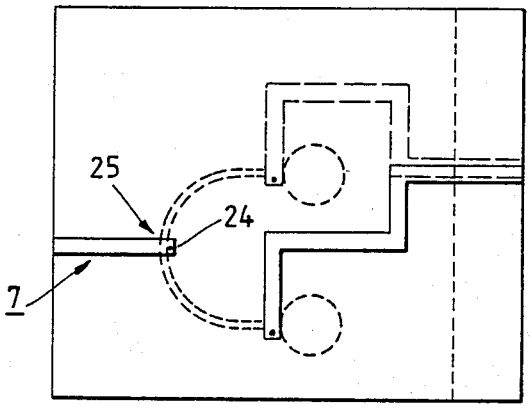
Figure 6:
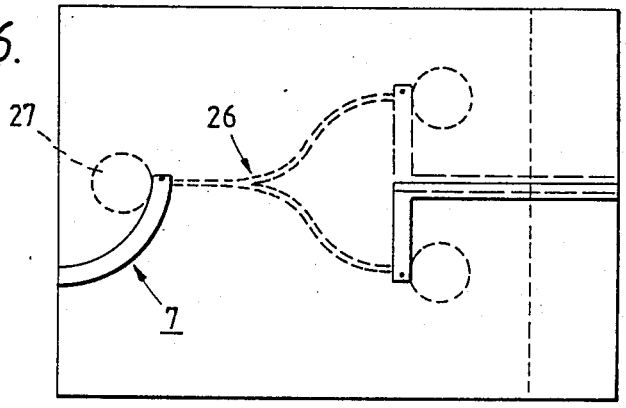

FIGS. 5 and 6 show respectively third and fourth embodiments in each of which both paths comprise a slot line as in the embodiment of FIG. 4, and each of which comprises a series-T junction for coupling the two paths to the unbalanced port. In the third embodiment illustrated by FIG. 5, the slot lines are mutually contiguous at the point where the unbalanced line comprising strip conductor 7 crosses and is coupled to them with a conductive connection 24 through the substrate 1 to form the series-T junction, indicated at 25. In the fourth embodiment illustrated by FIG. 6, the series-T junction is a slot-line Y-junction 26, to one arm of which the unbalanced line comprising strip conductor 7 is coupled in a broadband manner adjacent an open-circuit termination 27.

In each of the embodiments of FIGS. 4–6, the second and third microstrip lines comprising strip conductors 9, 10 (and hence the two adjacent strip conductors 16, 17) are coupled to their respective slot lines in opposite electrical senses with reference to the first unbalanced line comprising strip conductor pattern 7 whereby signals of mutually opposite phases are obtained from a signal at the unbalanced port; however, it is not necessarily possible to identify that one of the two paths has a phase reversal and the other not, but more generally that a signal at the unbalanced port produces signals of mutually opposite phases with respect to the common ground conductor of the two unbalanced lines.

Figure 7:
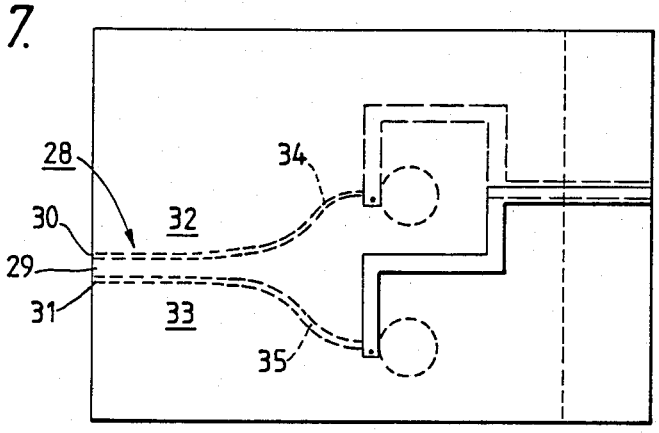
Figure 8:
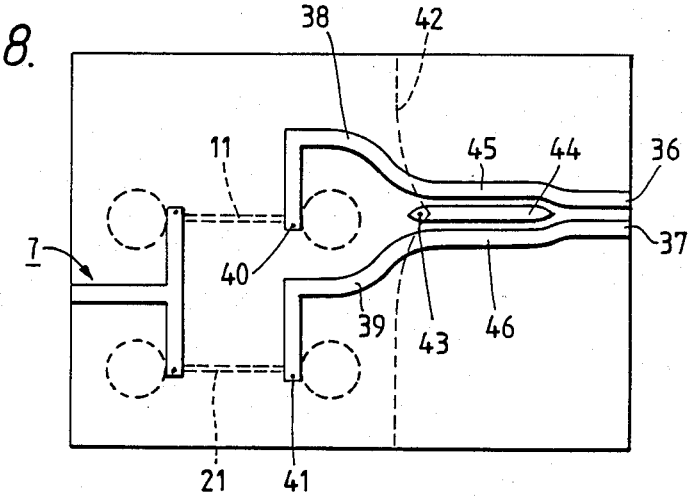
FIG. 8 is a plan view of a sixth embodiment with an alternative form of balanced line.

FIG. 7 shows a fifth embodiment in which the unbalanced line comprising the unbalanced port is a coplanar line, denoted 28, rather than a microstrip line. The coplanar line 28 is in this instance formed in the central conductive layer 3, and comprises a central strip conductor 29 separated by gaps 30 and 31 from two portions 32 and 33 of the layer 3 that constitute a ground plane. Towards its right-hand end (as drawn), the width of the central conductor 29 gradually and progressively increases, so that the gaps 30 and 31 becomes two respective slot lines 34, 35 in the ground plane layer 3. Since the electric field vectors at corresponding points along the gaps 30, 31 (and hence along the respectively contiguous slot lines 34, 35) are oppositely directed, the desired mutually opposite phases in the second and third unbalanced lines are obtained by coupling the latter lines to the two slot lines in the same electrical senses.

The above-described baluns embodying the invention are constructed on two substrates contiguous with a central conductive layer, and require conductive connections between the central layer and conductive layers respectively on the major surface of each substrates remove from the central layers. The substrates are initially separate, and the conductive layers which are to become the central layer and one of the outer layers may be provided on a first of the substrates (for example, layers 3 and 4 may be provided on substrate 1), and the other outer layer provided on the second substrate. The conductive connections between the layers on the first substrate may be made in known manner. A connection between the layer on the first substrate that is to become the central layer and the layer on the second substrate may be made by providing a bore in the second substrate in the appropriate position, bonding a conductive wire or foil to the "central" layer on the first substrate (for example by thermocompression bonding or soldering), applying an adhesive to the free surface of the "central" layer, offering up the second substrate to the first so as to pass the wire or foil through the aperture in the second substrate, and making a suitable contact between the wire or foil and the layer on the outer surface of the second substrate. The free space in the bore in the second substrate may then if necessary be filled with conducting epoxy adhesive or by electroplating.

FIG. 8 shows an embodiment with an alternative form of balanced line wherein the two elongate strip conductors, denoted 36 and 37, are coplanar rather than being in spaced parallel planes. This balanced line may be used with a simple modification of any of the above-described arrangement of unbalanced line and slot line(s) in the first portion of the balun. In the embodiment of FIG. 8, it is shown by way of example with the arrangement of FIG. 4. Since the strip conductors of the balanced line are coplanar, embodiments with such a line can be formed on a single substrate. In the embodiment of FIG. 8, the strip conductor pattern 7 of the first microstrip line comprising the unbalanced port and the two strip conductors 36 and 37 of the balanced line are depicted on the upper surface of the substrate and the ground plane, comprising the slot lines 11 and 21, on the lower surface. Since strip conductors 36 and 37 are coplanar, the strip conductor patterns 38 and 39 of the two microstrip lines respectively coupling the strip conductors 36, 37 to the slot lines can similarly be coplanar, with respective conductive connections 40 and 41 each extending between the upper and lower surfaces of the same substrate.

To form the transition from the two microstrip lines to the balanced line, the strip conductors 38 and 39 of the microstrip lines approach each other as the edge 42 of the ground plane tapers to a point which is disposed centrally beneath the conductors and at which a conductive connection 43 connects the ground plane on the lower surface of the substrate to a strip conductor 44 on the upper surface. The strip conductor 44 extends away from the ground plane between strip conductors 45, 46 which are respectively contiguous with strip conductors 38, 36 and with strip conductors 39, 37. The central conductors 44 forms with conductors 45 and 46 two adjacent unbalanced strip transmission lines, with conductor 44 being a common ground conductor. Transferring the common ground conductor of the adjacent unbalanced lines from the lower surface (the ground plane) to the upper surface (strip conductor 44) results in the electric field patterns of the lines being rotated from generally normal to the substrate to generally parallel to the substrate. At its end remote from the conductive connection 43, the strip conductor 44 is tapered, and the strip conductors approach each other further as the common ground conductor terminates and the adjacent antiphase unbalanced lines become a single balanced line.

Baluns embodying the invention which use a shunt-T junction to couple the two adjacent strip conductors to the unbalanced port (as ion FIGS. 1, 4 and 8) provide a 1:4 impedance transformation from the unbalanced port to the balanced port (so that, for example, a 50 ohm unbalanced line can be matched to a 200 ohm balanced line). If a series-T junction is used instead (as in FIGS. 5 and 6), the impedance transformation is, it is thought, 1:1.

Baluns which embody the invention and which are formed on at least one substrate need not be strictly planar but may for example be shaped to conform to a curved surface.

We claim:

1. A balun having an unbalanced port comprising a first unbalanced transmission line and a balanced port comprising a balanced transmission line formed by two adjacent elongate strip conductors of substantially the same widths between which in operation an electric field extends, wherein the two strip conductors are coupled to the unbalanced port by respective paths of substantially the same effective electrical lengths, wherein the paths comprise adjacent respective further unbalanced transmission lines which are strip transmission lines having a common ground conductor, wherein there is a transition from the adjacent unbalanced lines to said balanced line in which transition the common ground conductor terminates, and wherein at least one of the paths comprise slot line means and strip transmission line-to-slot line coupling means so arranged as in operation to provide in the two strip conductors from an RF signal in the first unbalanced line RF signals of mutually opposite phases with respect to the common ground conductor.

2. A balun as claimed in claim 1 wherein said first unbalanced line is a coplanar line comprising a central strip conductor separated by respective gaps from two portions of a ground plane respectively on opposite sides of the central conductor, and wherein said slot line means and coupling means comprise two slot lines respectively contiguous with said gaps, said two elongate strip conductors being respectively coupled to the two slot lines in the same electrical senses.

3. A balun as claimed in claim 1 wherein the two strip conductors are coupled to the unbalanced port by a shunt-T junction formed in said first unbalanced lines.

4. A balun as claimed in claim 3 wherein a single one of the paths comprises slot line means, said first unbalanced line and a first of the strip conductors being coupled thereto in opposite electrical senses.

5. A balun as claimed in claim 1 or 3 wherein said slot line means and coupling means comprises in each path a slot line to which said first unbalanced line and a respective one of the further unbalanced lines are coupled, the further unbalanced lines being coupled to their respective slot lines in opposite electrical senses with reference to said first unbalanced line.

6. A balun as claimed in claim 5 wherein said common ground conductor comprises ground plane.

7. A balun as claimed in claim 5 comprising a series-T junction coupling the two slot lines to said first unbalanced line.

8. A balun as claimed in claim 7 wherein said common ground conductor comprises a ground plane.

9. A balun as claimed in claim 1, 3 or 4 wherein said first unbalanced line is a microstrip line comprising a strip conductor pattern and a ground plane, and wherein the slot line means are formed in said ground plane.

10. A balun as claimed in claim 9 wherein said common ground conductor comprises said ground plane.

11. A balun as claimed in claim 9 wherein said slot line means and coupling means comprise in each path a slot line to which said first unbalanced line and a respective one of the further unbalanced lines are coupled, the further unbalanced lines being coupled to their respective slot lines in opposite electrical senses with reference to said first unbalanced line.

12. A balun as claimed in claim 9 wherein said slot line means comprises two slot lines each in a path, and further comprising a series-T junction coupling the two slot lines to said first unbalanced line.

13. A balun as claimed in claim 9 wherein the second of the two elongate strip conductors is substantially coplanar and integral with the strip conductor pattern of said microstrip line.

14. A balun as claimed in claim 13 wherein said common ground conductor comprises said ground plane.

15. A balun as claimed in claim 1, 2, 3 or 4 wherein the two elongate strip conductors are substantially in spaced respective parallel planes, and are substantially superimposed as viewed in a direction normal to said planes.

16. A balun as claimed in claim 15 wherein the or each slot line means is formed in a ground plane between the respective planes of the two elongate strip conductors, the ground plane terminating between the superimposed strip conductors.

17. A balun as claimed in claim 16 wherein said common ground conductor comprises said ground plane, and said balun is formed on two dielectric substrates disposed respectively on opposite sides of said ground plane and each having a major surface contiguous therewith, wherein on a major surface, remote from said ground plane, of a first of the two substrates are the second strip conductor and the strip conductor pattern of said microstrip line, and wherein on a major surface, remote from said conductive layer, of the second substrate is the first strip conductor.

18. A balun as claimed in claim 1, 3, or 4 wherein the two elongate strip conductors are substantially coplanar.

19. A balun as claimed in claim 18 wherein said common ground conductor comprises a ground plane an d said transition comprises a third strip conductor which is connected at one end thereof to said ground plane at an edge thereof, which extends away from said ground plane, and which is disposed between fourth and fifth strip conductors, contiguous with the two elongate strip conductors, to form therewith a further unbalanced transmission line, and wherein said ground plane and the fourth and fifth strip conductors form said adjacent further unbalanced transmission lines.

* * * * *